US011497273B2

(12) United States Patent
Adametz et al.

(10) Patent No.: US 11,497,273 B2
(45) Date of Patent: Nov. 15, 2022

(54) SPRING CUSHIONED SHOE WITH ENCAPSULATED SPRING

(71) Applicant: Spira, Inc., Los Angeles, CA (US)

(72) Inventors: Kevin Adametz, Los Angeles, CA (US); Robert Azar, Los Angeles, CA (US)

(73) Assignee: Spira, Inc., Los Angeles, CA (US)

( * ) Notice: Subject to any disclaimer, the term of this patent is extended or adjusted under 35 U.S.C. 154(b) by 149 days.

(21) Appl. No.: 16/968,560

(22) PCT Filed: Aug. 29, 2018

(86) PCT No.: PCT/US2018/048631
§ 371 (c)(1),
(2) Date: Aug. 7, 2020

(87) PCT Pub. No.: WO2019/046485
PCT Pub. Date: Mar. 7, 2019

(65) Prior Publication Data

US 2021/0037914 A1 Feb. 11, 2021

Related U.S. Application Data

(60) Provisional application No. 62/551,551, filed on Aug. 29, 2017.

(51) Int. Cl.
*A43B 13/18* (2006.01)

(52) U.S. Cl.
CPC ..... *A43B 13/183* (2013.01)

(58) Field of Classification Search
CPC ..... A43B 13/183; A43B 13/18; A43B 13/181; A43B 13/182
See application file for complete search history.

(56) References Cited

U.S. PATENT DOCUMENTS

| | | | |
|---|---|---|---|
| 4,901,987 | A | 2/1990 | Greenhill et al. |
| 5,639,074 | A | 6/1997 | Greenhill et al. |
| 5,743,028 | A | 4/1998 | Lombardino |
| 6,006,449 | A | 12/1999 | Orlowski et al. |

(Continued)

FOREIGN PATENT DOCUMENTS

| | | |
|---|---|---|
| EP | 3675674 A4 | 5/2021 |
| KR | 200305809 Y1 | 3/2003 |

(Continued)

OTHER PUBLICATIONS

International Preliminary Report on Patentability and Written Opinion of the International Searching Authority from PCT/US2018/048631, dated Mar. 3, 2020.

(Continued)

*Primary Examiner* — Ted Kavanaugh
(74) *Attorney, Agent, or Firm* — Buchalter, a Professional corporation

(57) ABSTRACT

A sole assembly for an article of footwear comprises a midsole, a sole having a heel region, and a first wave spring disposed within a vacuity located within the heel region. The wave spring includes a top surface and a bottom surface. A plate, resting upon the top surface of the wave spring, is unsecured to the midsole and sized to permit movement within the vacuity along with the wave spring responsive to a rolling foot strike.

18 Claims, 11 Drawing Sheets

(56) References Cited

U.S. PATENT DOCUMENTS

| | | | | |
|---|---|---|---|---|
| 6,665,957 | B2 | 12/2003 | Levert et al. | |
| 6,886,274 | B2 * | 5/2005 | Krafsur | A43B 7/1425 36/27 |
| 7,219,447 | B2 * | 5/2007 | LeVert | A43B 7/1425 36/27 |
| 2002/0073579 | A1 | 6/2002 | Lombardino | |
| 2002/0088142 | A1 | 7/2002 | LeVert et al. | |
| 2002/0174567 | A1 | 11/2002 | Krafsur et al. | |
| 2007/0294916 | A1 | 12/2007 | Park | |
| 2008/0189982 | A1 | 8/2008 | Krafsur | |
| 2008/0209762 | A1 | 9/2008 | Krafsur | |

FOREIGN PATENT DOCUMENTS

| | | | |
|---|---|---|---|
| KR | 100775362 | B1 | 11/2007 |
| KR | 101351057 | B1 | 1/2014 |
| WO | 2014054822 | A1 | 4/2014 |
| WO | 2014123302 | A1 | 8/2014 |
| WO | 2019046485 | A1 | 3/2019 |

OTHER PUBLICATIONS

International Search Report from PCT/US2018/048631, dated Oct. 23, 2018.

* cited by examiner

SPRING CUSHIONED SHOE WITH ENCAPSULATED SPRING

BACKGROUND

Field

Aspects of the present disclosure generally relate to footwear. More specifically, the present disclosure relates to the use of wave springs as cushioning in a shoe.

Background

Several approaches have been employed to cushion a person's feet while walking, running, hiking, and/or jumping. The use of various foams, air pockets, gels, and/or other materials for the insole, outer sole, or between the insole and outer sole of various types of footwear are currently in use.

Related art attempts have been made to incorporate springs into footwear, with very little success. Compression springs often have a spring constant that is not appropriate for footwear, as the spring is either fully compressed or not compressed enough by the forces placed on the spring when used in a shoe. Torsion springs often place the spring force over a very small area. When the area for compression is increased, the spring constant of a torsion spring suffers from the same deficiencies as compression springs.

People involved in exercise programs often seek new equipment that can minimize the risk of injury. A common reason for injury is stress due to a foot striking the ground, which sends pressure waves through a person's legs. Athletes also look for ways to improve their performance levels in a variety of athletic events involving walking, running, or jumping. Such athletes also want to reduce the wear and tear caused by the events and/or sports they participate in. These desires can be achieved to some degree by the use of improved sporting equipment, and more specifically improved shoes for both athletes and non-athletes.

The mechanics of running or walking involve a prescribed set of motions insofar as the foot is concerned. With the exception of sprinting events, the heel impacts the ground first, the weight then shifts forward onto the ball of the foot in a rolling manner with the toe region providing the last contact with the ground. The initial impact in the heel area is of interest with non-sprinting runners, because the impact in the heel area creates a large possibility for injury.

It is desirable to absorb this impact energy while still providing a stable landing area and without slowing down the runner. It is also desirable to avoid too much loss of energy to absorption by the shoe at impact. Further, since the ball and toe areas of the foot are the last to leave the surface in contact with the ground, it is desirable to attempt to recover some of the absorbed energy lost in the initial impact.

The above mentioned desirable attributes of a shoe indicate that there is a need for a shoe that enhances the performance of the wearer by providing a substantial force working through a significant distance while using a reduced volume for deployment. In addition there is a need for a shoe design that also assists in propelling the foot off the ground while still maintaining sufficient lateral stability of the shoe for quick side-to-side movement of the wearer.

SUMMARY

The present disclosure describes methods and apparatuses for cushioning in a shoe. Wave springs, which may be encapsulated in a compressible material, may be placed in the sole of a shoe, such as in the ball of the foot area and/or heel area of the sole of a shoe.

In one embodiment of the present disclosure, the middle portion sole of the shoe sole assembly comprises a foam material having vacuities located at or near the ball and heel regions of the foot. Wave springs, encapsulated in a compressible material, are placed in the vacuities.

In another embodiment of the present disclosure, a sole assembly for an article of footwear comprises a midsole, a sole having a heel region, and a first wave spring disposed within a vacuity located within the heel region. The wave spring includes a top surface and a bottom surface. A plate, resting upon the top surface of the wave spring, may be unsecured to the midsole. The wave spring is encapsulated in a compressible material.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further purposes and advantages, will be better understood from the following description when considered in connection with the accompanying figures. It is to be expressly understood, however, that each of the figures is provided for the purposes of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

Overview

The present disclosure relates to the use of wave springs and polymers as integral parts of shoes to cushion the impact of foot strikes and to provide recuperative energy return to the wearer. A spring-cushioned shoe incorporating the various features of the present disclosure is illustrated generally as spring-cushioned shoe (SCS) 2 in FIGS. 1 and 2.

In an aspect of the present disclosure, a wave spring may be encapsulated in a compressible plastic and/or other polymer to provide impact suppression and/or energy return to the wearer. Such advantages and/or improvements may be achieved by storing the shock energy imparted by a foot strike and returning a substantial amount of the energy to the wearer's foot during the propelling-off portion of the stride.

In an aspect of the present disclosure, a wave spring is used to reduce impact on the user during a foot strike, which may increase comfort and/or decrease the possibility for injury. Wave springs, which may be encapsulated in a plastic and/or polymer, may also return a portion of the impact energy to the user for more efficient jumping, walking and/or running. The encapsulation of the spring in a plastic and/or polymer material may increase the useful life of the wave spring, and thus the shoe, by sharing the absorption and/or return of energy to the user with the spring.

Figure 1:
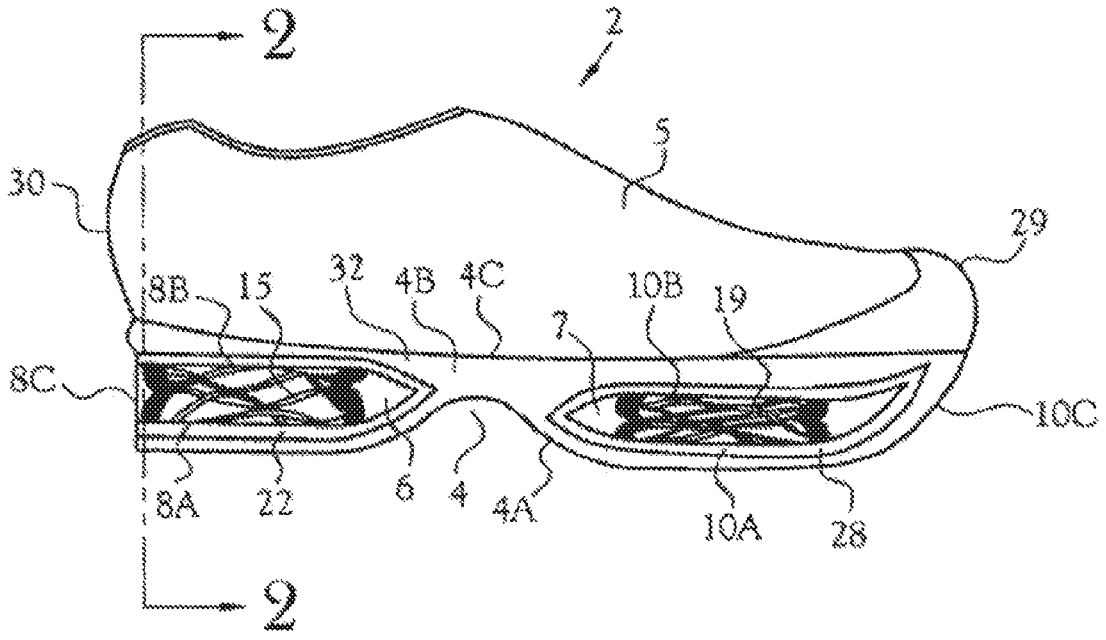
FIG. 1 illustrates a side view of one embodiment of a spring-cushioned shoe in an aspect of the present disclosure.
Figure 2:
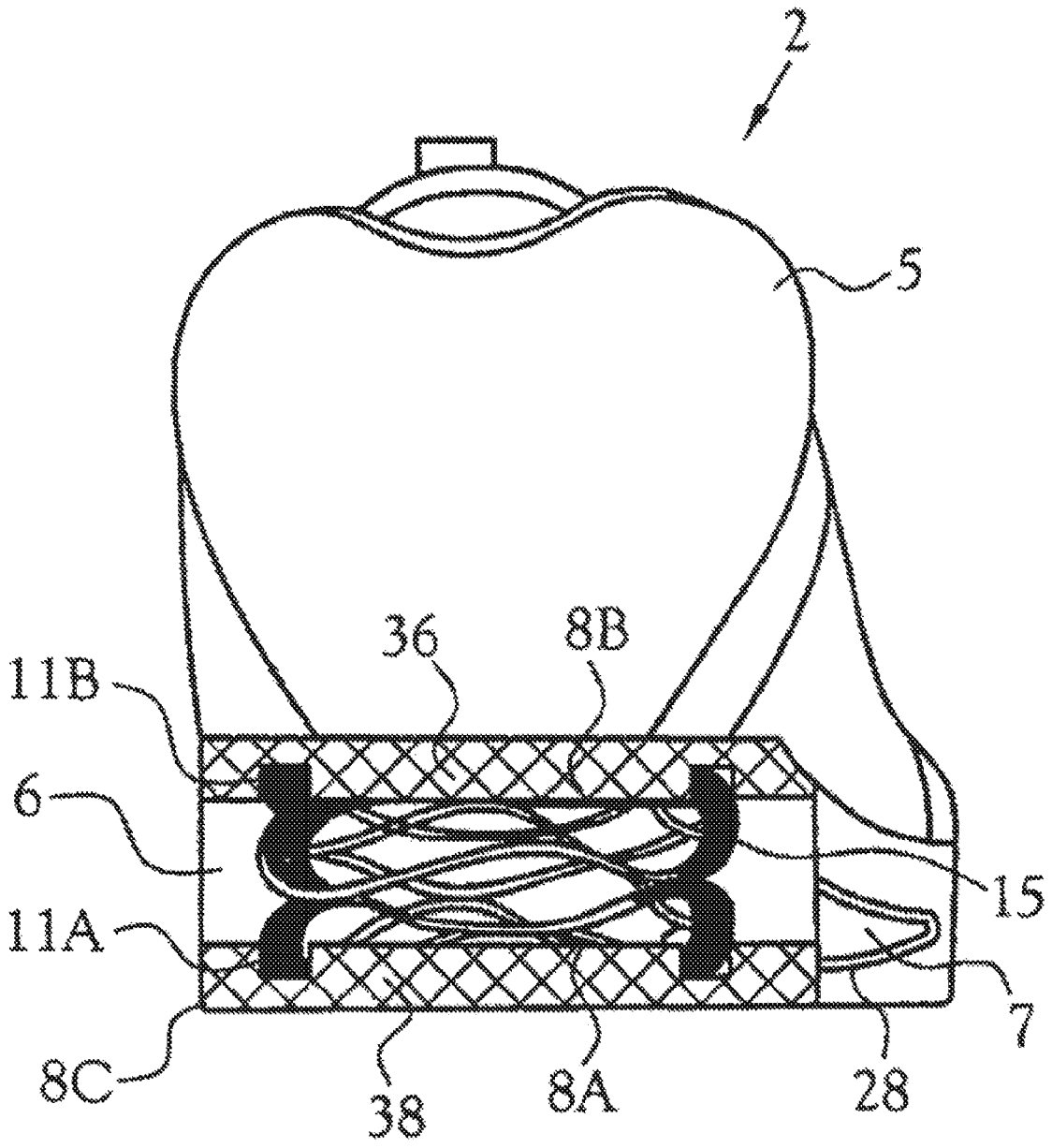
FIG. 2 illustrates a cross sectional view of the spring-cushioned shoe taken in the heel region of the spring cushioned shoe in an aspect of the present disclosure.

FIGS. 1 and 2 illustrate a side view and a cross-sectional view of the heel section, respectively, of one embodiment of a spring-cushioned shoe in an aspect of the present disclosure.

Referring to FIGS. 1 and 2, SCS 2 comprises an upper shoe portion 5 attached to shoe sole assembly 4. Shoe sole assembly 4 includes an outer sole 4A with first and second surfaces, middle sole 4B having first and second surfaces positioned such that the first surface of middle sole 4B is attached to the second surface of outer sole 4A, and inner sole 4C whose first surface is attached to the second surface of middle sole 4B and whose second surface is in contact with the lower region of upper shoe portion 5.

In an aspect of the present disclosure, middle sole 4B may be made from a foamed polymeric material, and the inner and outer soles 4A and 4C may be made from one or more solid polymeric materials. In a particular embodiment of the present disclosure, outer sole 4A comprises ethyl vinyl acetate with the first surface of outer sole 4A having tractive characteristics.

Middle sole 4B is designed to define vacuities 6 and 7. Vacuity 6 is defined by vertically opposing surfaces 8A and 8B of foamed polymeric material of middle sole 4B, and is formed in the heel region 8C of SCS 2. Surfaces 8A and 8B, which are set apart from the second and first surfaces of middle sole 4B, respectively, define relatively thicker sections of middle sole 4B in the heel area of the shoe sole assembly 4 into which cylindrical countersunk volumes 11A and 11B, respectively, are formed as shown in FIG. 2.

Vacuity 7 is disposed between vertically opposing surfaces 10A and 10B of foamed polymeric material 4B in the region 10C of shoe sole assembly 4. Like surfaces 8A and 8B, surfaces 10A and 10B define relatively thicker sections of material of middle sole 4B located below and above the vacuity 7 in the vertical direction such that cylindrical countersunk volumes, similar to the countersunk volumes 11A and 11B can be formed therein. The cylindrical countersunk volumes provide vertical stabilization and retention of the wave springs 15 and 19. Although shown as cylindrical volumes 11A and 11B, the volumes 11A and 11B may be of other shapes, e.g., cubical, frustoconical, hexagonal, etc., without departing from the scope of the present disclosure. The shoe sole assembly 4 is firmly attached to upper portion 5 of SCS 2. Wave springs 15 and 19 are deployed in vacuities 6 and 7 of foamed polymeric material 4B of shoe sole assembly 4, respectively.

Figure 3:
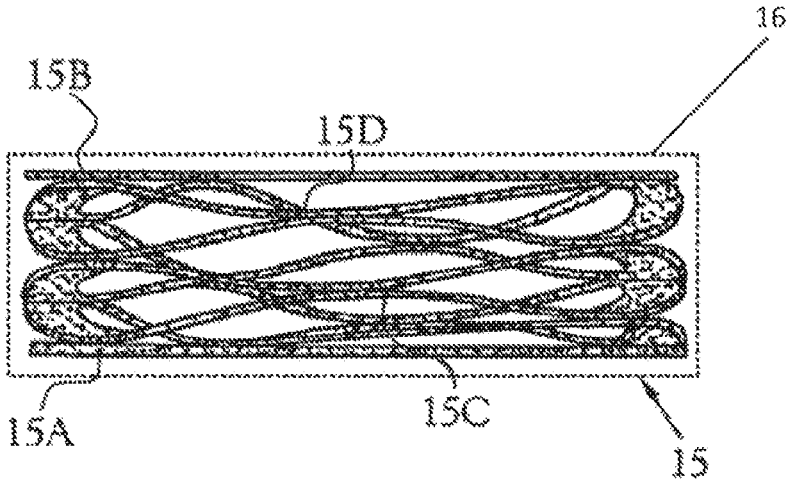
FIG. 3 illustrates a view of the wave spring component in an aspect of the present disclosure.

FIG. 3 illustrates a view of the wave spring component in an aspect of the present disclosure.

Wave springs 15 and 19 are generally described by Greenhill in U.S. Pat. No. 4,901,987, which is expressly incorporated by reference herein. Greenhill describes a multi turn wave spring having crests and troughs. In an aspect of the present disclosure, the orientation of crests and troughs, and/or the number of turns comprising wave spring 15 and/or 19, may be oriented in a certain direction with respect to the sole assembly 4. Such orientation(s) may allow for additional tuning of the spring with respect to the wearer, or may provide correction for pronation/supination and/or other foot positioning during the stride of the wearer. Wave spring 15 with circular flat shim ends 15A and 15B and wave crest 15C and wave trough 15D with prescribed periodicity are shown in FIG. 3. Although shown as metal springs, springs 15 and/or 19 may be made from other materials, e.g., carbon fiber, graphite, other types of plastic and/or polymer materials, and/or other materials without departing from the scope of the present disclosure.

The configuration of wave springs 15 and 19 provide for operationally acceptable force and deflection for a given free height of the springs. For example, and not by way of limitation, the inner diameter his needs some explanation; what range is operationally acceptable?) The wave springs of the preferred embodiment of this disclosure could be replaced with multi turn wave springs which do not employ flat shim ends but rather rely on the use of flat end plates in combination with ordinary wave springs.

The multi-turn wave spring 15 includes an upper turn 100 and a lower turn 102. The upper turn 100 is in pivotal contact with the lower turn 102 through tangential contact between the trough 104 of the upper turn 100 and the crest 106 of the lower turn 102 and through tangential contact between the trough 108 of the upper turn 100 and the crest 110 of the lower turn 102. The pivotal contact between the crests 106 and 110 with the troughs 104 and 108, respectively, defines a first side 110 and a second side 111 of the multi-turn wave spring 15.

It will be recognized by those skilled in the art that the springs 15 and 19 may be formed in non-cylindrical shapes. For example, an oval perimeter can be used for the spring 19 in the ball region 10C to allow improved positioning of the metatarsal bones of the foot, as well as improved flexibility of the shoe. Further, springs 15 and/or 19 may be removable from sole assembly 4 to allow for customization of the shoe 2 to an individual person. For example, and not by way of limitation, a spring with a large force constant can be inserted into a shoe for a larger and/or heavier person, while a spring of the same size but having a smaller force constant may be inserted into a shoe for a smaller and/or lighter person, to allow the spring to be compressed by each person in proportion to the forces that a particular person will impart on the spring 15 and/or 19.

The cylindrical countersunk volumes 11A and 11B are designed to slidably receive the first and second shim ends 15A and 15B of wave spring 15, respectively, in heel region 8C. When fully inserted, the flat shim ends 15A and 15B of wave spring 15 are held in firm mechanical contact with the closed ends of cylindrical countersunk volumes 11A and 11B, respectively.

The region of shoe sole assembly 4 of the SCS 2 that is normally proximate the metatarsal region of the foot likewise has surfaces 10A and 10B (see FIGS. 1 and 4) that contain similar countersunk cylindrical (and/or frustoconical and/or other shaped) volumes (not shown) for slidably accepting in the following order the first shim end and the second shim end (not shown), respectively, of wave spring 19. When fully inserted, the shim ends of wave springs 19 are in mechanical contact with the closed end portions of cylindrical volumes.

Encapsulant 16 shown in FIG. 3 is shown as surrounding, covering, and/or encapsulating wave spring 15. Encapsulant 16 may be a polymer material such as polypropylene, polyurethane, polystyrene, ethylene vinyl acetate (EVA), rubber, plastic, foam, other polymers, and/or other compressible materials without departing from the scope of the present disclosure. Further, encapsulant 16 may be used to couple each of the crests and troughs of the wave spring 15. For example, and not by way of limitation, the crests and troughs of the turns of the wave springs may be attached by the encapsulant 16 if desired.

Because the encapsulant 16 may be compressible, encapsulant 16 may provide additional absorption and/or return of the energy imparted to wave spring 15 during walking, running, or other movement of the wearer of SCS 2. Further, this compressibility of encapsulant 16 may be used in superposition with the compressibility (spring constant) of wave spring 15 to provide an overall compression factor for a given SCS 2 design. For example, and not by way of limitation, a shoe 2 that may use a spring 15 having a constant of 425 pound-feet per inch, may be replaced with a spring 15 having a constant of 375 pound-feet per inch encapsulated in an encapsulant 16 having a constant of 50 pound-feet per inch. Such a substitution may yield a spring 15/encapsulant 16 combination having an equivalent compressibility, but possibly having a longer service life and/or cost reduction in manufacturing of shoe 2.

Encapsulant 16 may also extend the life of wave spring 15, in that the stresses on the contact points between the turns of the wave spring 15 are now at least partially supported by encapsulant 16, rather than being supported by air. Encapsulant 16 may also provide additional lateral stability to SCS 2, as encapsulant 16 may be employed to provide a better fit for wave spring 15 into volumes 11A and 11B. Encapsulant 16 may also only be surrounding wave spring 15 and not present in the central portion of wave spring 16, to allow for additional control of the comfort and/or performance of SCS 2 as desired.

Figure 4:
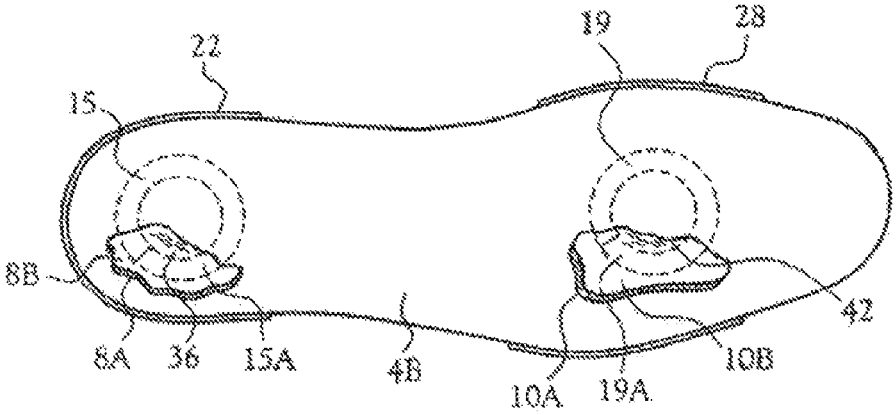
FIG. 4 illustrates a plan view of the outer sole of the spring-cushioned shoe in an aspect of the present disclosure.

FIG. 4 illustrates a plan view of the outer sole of the spring-cushioned shoe in an aspect of the present disclosure.

As shown in FIG. 4, the surfaces 8A and 8B are mechanically held in a manner so as to provide minimal compressive loading on the shim ends 15A and 15B of wave spring 15 by transparent strip 22 which is connected thereto by adhesive. Similarly, transparent strip 28, when adhesively attached to the surfaces 10A and 10B, provides a slight compressive load on shim ends 19A and 19B of wave spring 19. In addition to sealing vacuities 6 and 7 from the environment, strips 22 and 28 provide some lateral stability for the users of the SCS 2. It should be apparent that the strips 22 and 28 could also be made from a number of various materials. In FIG. 1, the upper portion 5 of the SCS 2 is made of high strength synthetic fabric. The materials that comprise the SCS 2 are not limited to only those mentioned in this disclosure. Any number of materials can be used in the manufacturing of the shoes of this disclosure. The cylindrical countersunk volumes 11A and 11B and similar volumes defined in surfaces 10A and 10B, along with transparent strips 22 and 28, provide for retention and vertical stabilization of the wave springs 15 and 19 when they are inserted into vacuities 6 and 7 respectively.

Referring to the embodiment of the present disclosure shown in FIG. 1, the front end 29, the rear end 30 and the middle region 32 of the shoe sole assembly 4 of the SCS 2 are designed to provide retentive support for wave springs 15 and 19 that augments support provided by transparent strips 22 and 28. Such retentive support consists of strips that connect the shoe sole assembly 4 to the upper shoe portion 5. In FIG. 1, wave springs 15 and 19 are deployed in vacuities 6 and 7 in shoe sole assembly 4, which is attached to shoe upper portion 5. The cross sectional view in FIG. 2 shows interior wave spring compression limiters 36 and 38, which are integral parts of cylindrical countersunk volumes 11A and 11B, respectively. That is, the compression limiter's outer dimensions define the inner diameters of countersunk volumes 11A and 11B, respectively.

The opposing spring compression limiters 36 and 38 (see FIGS. 2 and 4) are separated by the extended wave spring 15 whose solid height when fully compressed by the strike force of the foot of a user is less than the linear distance in the vertical direction between spring compression limiters 36 and 38. The heights of compression limiters 36 and 38 are prescribed by the depth of the countersunk cylindrical volumes 11A and 11B in surfaces 8A and 8B, respectively. In one embodiment of the shoes of the present disclosure, the distance between the terminal ends of compression limiters 36 and 38 were set at 12 mm. The heights of spring compression limiters 36 and 38 are related mathematically to the spring constant of the wave spring and the mass of the user and are chosen such that the wave spring 15 cannot be compressed to its solid height during use. Accordingly, because of the force generated at the portion of shoe sole assembly 4 of the SCS 2 that is normally proximate the metatarsal of the foot during normal use, the distance between the terminal ends of spring compression limiters 42 and 44 is set at 9 mm.

The distance between the spring compression limiters of the wave spring 19 and the spring constant of wave spring 19 were selected such that the force generated, when the first surface of shoe sole assembly 4 opposite the ball of the foot contacts a surface while running, cannot compress wave spring 19 to its solid height.

The compression limiters 36 and 38 are used to prevent overstressing of the wave springs 15 and 19, thus increasing the operational life of the springs. Alternatively, the turns of the multi-turn wave springs may be spaced close enough to prevent the spring from compressing to an overstressed state. That is, the wave spring is made with a low profile so that the maximum spring deflection does not reach an overstressed condition.

Wave springs 15 and 19 may be slidably inserted onto lower middle sole compression limiters 38 and 44 while flat plate(s) or even a single lasting board is placed above wave springs 15 and 19 and bonded to the perimeter of the top of the shoe middle sole 4B.

It will be recognized by one skilled in the art that, depending on the weight of the user, the prescribed distances between the terminal ends spring compression limiters will vary. In the present disclosure, the vacuities 6 and 7 of shoe sole assembly 4 were formed by splitting middle sole 4B into two substantially equal slabs forwardly from the heel area toward the toe of the shoe. The cylindrical countersunk volumes 11A and 11B were formed by machining, at the proper locations and depths, in foam polymeric material of the middle sole 4B. The combined depths of cylindrical countersunk volumes 11A and 11B were selected such that the heights of wave springs 15 and 19 would fill vacuities 6 and 7 at those regions of 4B, when inserted therein. Once wave springs 15 and 19 were inserted in the machined cylindrical countersunk volumes, the split portions of foamed polymeric material of middle sole 4B were adhesively reattached at the middle region of shoe sole assembly 4. The vacuities 6 and 7 are sealed by strips 22 and 28 respectively. The strips 22 and 28 were attached by adhesive to the shoe sole assembly 4 at the heel and ball of the foot regions of the SCS 2. The foamed polymeric material of middle sole 4B could be made from any number of elastic materials such as polyurethane.

The method for forming the vacuities 6 and 7 and fixing the wave springs 15 and 19 in the middle sole 4B of SCS 2 in the present disclosure was as discussed above. However, it will be apparent to one skilled in the art that the vacuities and spring retention methods could be formed by any number of manufacturing techniques available to the shoe industry, such as the use of a molding process with the springs being inserted into the assembled shoe sole. Alternatively, the complete shoe sole-spring assembly could be made in one single continuous process.

The force of a heel strike is substantially greater than the force of the strike to the ball portion of the foot. Accordingly, the wave spring 15, which primarily provides cushioning during foot strikes, has a free height selected to be greater than that of wave spring 19, which provides primarily liftoff force to the foot of a wearer.

Although the wave springs 15 and 19 used in the shoes of the depicted embodiment of this disclosure are metallic in construction, it will be recognized by one skilled in the art that the material of the wave springs is not solely limited to metals and that a wide variety of other materials could be used as well. Likewise, the materials used in the other parts of the shoe may be made from any multitude of materials commonly used in the art. While the shoe of this disclosure uses single leaf crest-to-crest wave springs, interlaced wave springs, as described in U.S. Pat. No. 5,639,074 or commercially available nested wave springs may be used as well. The interlaced and nested wave springs, like the crest-to-crest wave springs, provide the primary desirable characteristics of crest-to-crest wave springs important to the shoe of the disclosure. That is, like crest-to-crest wave springs, interlaced and nested wave springs provide maximum force and deflection for a given unloaded spring height and provide the cushioning and energy return responsive to a rolling foot strike.

Figure 5:
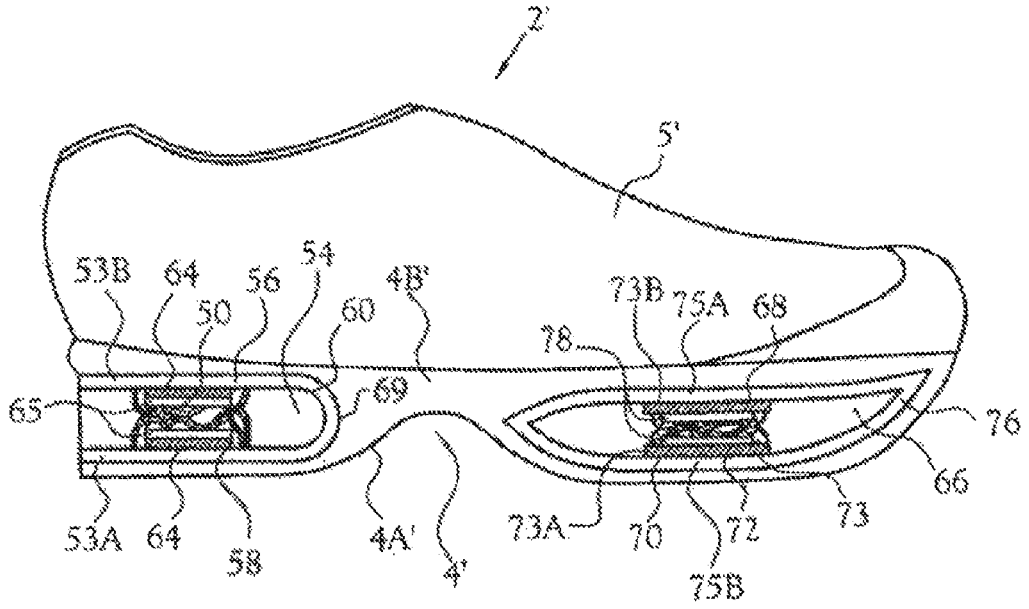
FIG. 5 illustrates a side elevation view of a second embodiment of the spring cushioned shoe in an aspect of the present disclosure.
Figure 6:
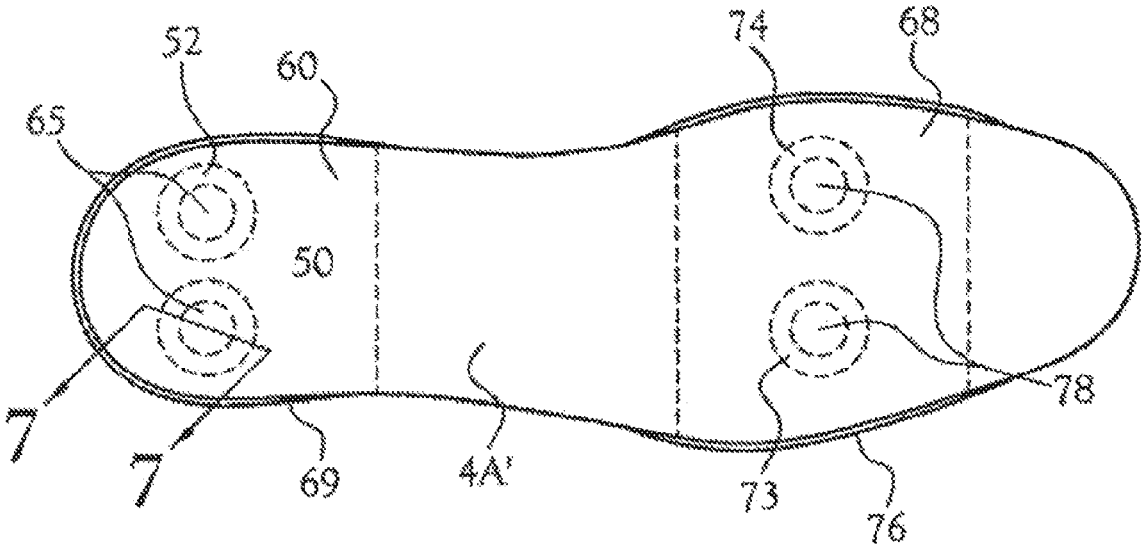
FIG. 6 illustrates a plan view of the outer sole of the second embodiment of the spring-cushioned shoe in an aspect of the present disclosure.
Figure 7:
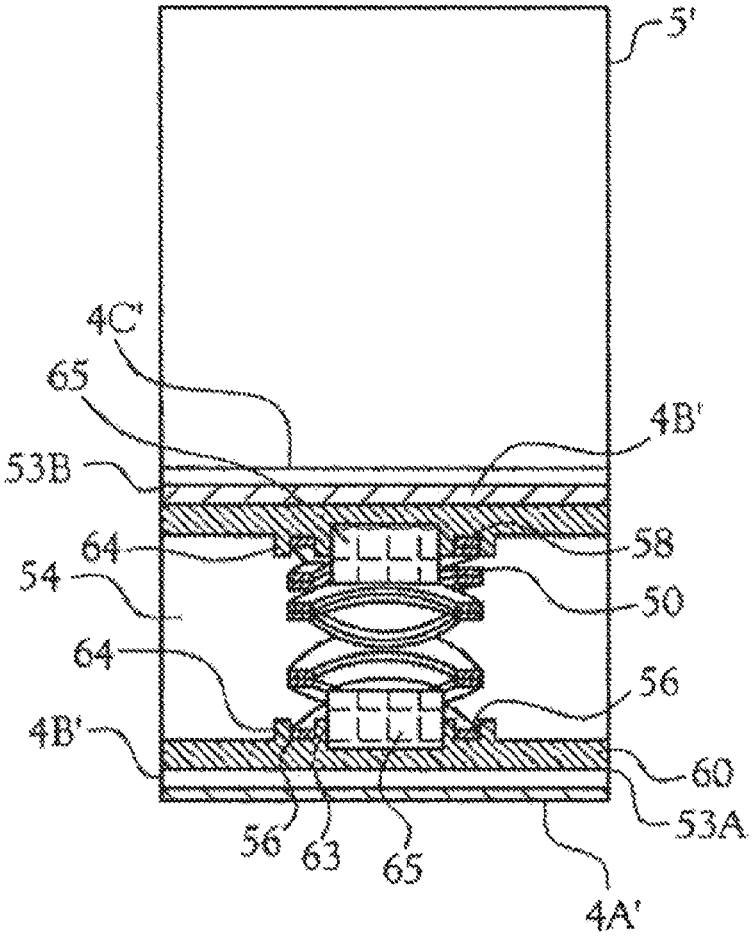
FIG. 7 illustrates a sectional view of one of the spring assemblies of the second embodiment of the spring-cushioned shoe with stabilizer and compression limiter in an aspect of the present disclosure.

FIG. 5 illustrates a side elevation view of a second embodiment of the spring cushioned shoe in an aspect of the present disclosure, FIG. 6 illustrates a plan view of the outer sole of the second embodiment of the spring-cushioned shoe in an aspect of the present disclosure, and FIG. 7 illustrates a sectional view of one of the spring assemblies of the second embodiment of the spring-cushioned shoe with stabilizer and compression limiter in an aspect of the present disclosure.

In FIGS. 5 and 6, wave springs 50 and 52 are mounted in vacuity 54 with their first and second terminal shim ends 56 and 58, respectively, mounted in U-shaped plastic receiving clip 60, which includes protrusions 64 as shown in FIG. 7. The protrusions 64' slidably accept the first and second terminal shim ends 56 and 58 of wave springs 50 and 52 to provide firm mechanical contact between the shim ends 56 and 58 and the closed ends 63 of protrusions 64 of U-shaped receiving plate 60. The U-shaped plastic receiving clip 60 containing wave springs 50 and 52 is inserted into vacuity 54 where it is attached, as by adhesive, to the plain interior surfaces 53A and 53B of vacuity 54 in heel area of foamed polymeric material 4B' of shoe sole assembly 4'. The U-shaped plastic-receiving clip 60 is designed to have one pair of cylindrically shaped compression limiters 65 associated with each wave spring.

Figure 10:
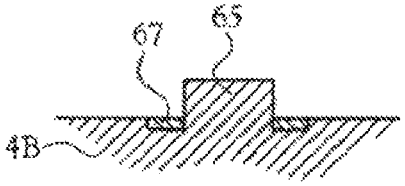
FIG. 10 illustrates an alternative embodiment of the illustration of FIG. 7 in an aspect of the present disclosure.

One of the terminal ends of each of the compression limiters 65 is adhesively attached to each of the opposing inner surfaces of clip 60 at the diametrical centers of protrusions 64 by adhesive, as shown in FIG. 7. The U-shaped plastic receiving clip 60 of this second embodiment of the shoes of this disclosure may be replaced by two plastic plates containing protrusions for slidably accepting the shim ends of one or a multiplicity of wave springs. Alternatively, as depicted in FIG. 10, the ends 67 may be embedded in the middle sole 4B. The vacuity 54 is sealed, as shown in FIGS. 5 and 6, with extensible plastic 69 to provide strength of the SCS 2' in the lateral, or side-to-side, direction during use.

Vacuity 66 is located in the metatarsal region of shoe sole assembly 4'. Plastic plates 68, and 70 include protrusions 72 substantially identical to protrusions 64 of FIG. 7 on their first surface into which the first and second shim ends 73A and 73B of wave springs 73 and the first and second shim ends (not shown) of wave spring 74 (FIG. 6) are slidably inserted. The plastic plates 68 and 70, in addition to the first surfaces, have substantially parallel second surfaces. The assembled unit consisting of plastic plates 68 and 70, protrusions 72 and wave springs 73 and 74 are inserted into vacuity 66 of shoe sole assembly 4'. The second surfaces of plastic plates 68 and 70, with wave springs 73 and 74 inserted therebetween, are attached to the plain interior surfaces 75A and 75B of vacuity 66 by adhesive. The plates 68 and 70 are designed to accept with minimal resistance compression limiters 78 which are attached to diametrical centers of plates 68 and 70 in a manner similar to that of compression limiters 65 to plates 68 and 70. The compression limiters 78 serve to limit the amount of compression that wave springs 73 and 74 can undergo during use. The vacuity 66 is sealed with extensible plastic 76.

It will be recognized by a person of ordinary skill in the art that more than two wave springs may be employed in each of the heel and metatarsal regions the shoes of this disclosure. A compression limiter, in this second embodiment, is associated with each wave spring. However, one or more strategically positioned pairs of regional compression limiters may be used to limit the compression of a plurality wave springs. Alternatively, a wave spring may be used only in the heel region 8C or only in the ball region 10C.

The spring-cushioned shoe of the second embodiment of this disclosure contains opposing plates, which are separated by intervening foam material shown in FIG. 5. The plastic plates may also be held firmly by friction or other mechanical means, other than the previous mentioned adhesive, for slidable insertion into, and removal from, the shoe sole assembly 4' to accommodate replacing the wave springs with other wave springs of different spring rates. Furthermore, the plastic plates may be concatenated, giving rise to a plastic member that extends from the heel area to the ball of the foot area of the shoe sole assembly. A shoe sole assembly designed to accept the plastic member may be equipped with a single vacuity that extends most of the full length of the shoe sole assembly.

The wave springs used in the depicted embodiment of the disclosure are made of spring steel with inner and outer diameters, transverse thicknesses, peak and trough heights and quantities' chosen so as to provide spring rates for wave spring 15 and 19 of 600 lb/in and 500 lb/in respectively.

The design parameters and materials of the wave springs are selected so as to provide springs of different spring forces and other characteristics. For example, other metallic and non-metallic materials, polymers, and composites may be selected for different weight and strength characteristics. Also, the design parameters of the wave springs may be altered to provide varying strength, deflection, and load characteristics. Further, the embodiment of this disclosure is described in terms of a single cushion shoe. It should be understood that the companion cushion shoe will be of similar design and construction.

Figure 8:
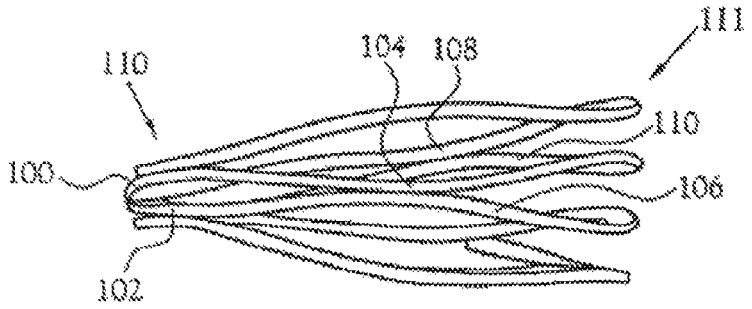
FIG. 8 illustrates a side elevation view of a wave spring with a first side compressed in an aspect of the present disclosure.
Figure 9:
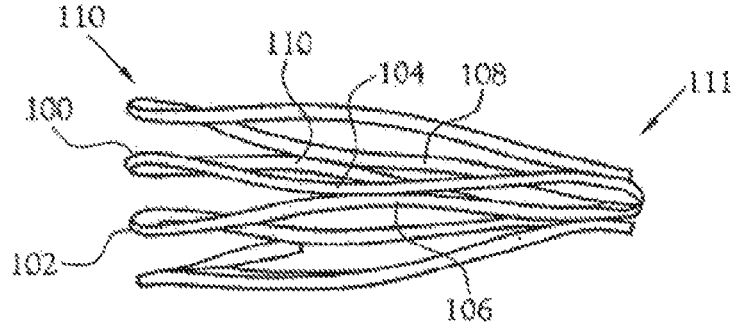
FIG. 9 illustrates a side elevation view of a wave spring with a second side compressed in an aspect of the present disclosure.

FIG. 8 illustrates a side elevation view of a wave spring with a first side compressed in an aspect of the present disclosure, and FIG. 9 illustrates a side elevation view of a wave spring with a second side compressed in an aspect of the present disclosure.

The sequential operation of the multi-turn wave spring 15 within a running shoe 2 is illustrated in FIGS. 3, 8 and 9. In FIG. 3, the spring 15 is illustrated in its relaxed condition, as it would be when the shoe is elevated off the ground. As the heel region 8C of the shoe 2 strikes the ground, the first side 110 is compressed. (See FIG. 8) Compression of the first side 110 transfers expansion pressure to the second side 111 through the pivotal contacts between the crests 106 and 110 with the troughs 104 and 108, respectively. As the rolling motion of the foot strike continues, the spring 15 returns to the condition illustrated in FIG. 3. Then the second side 111 is compressed. (See FIG. 9.) Compression of the second side 111 transfers expansion pressure to the first side 110 through the pivotal contacts between the crests 106 and 110 with the troughs 104 and 108, respectively. As the heel region 8C lifts off the ground, the spring 15 returns to the condition illustrated in FIG. 3. The spring 19 in the ball region 10C operates in a similar manner sequentially after the spring 15 to provide cushioning and energy return responsive to a rolling foot strike. The operation of the springs 15 and 19 is similar for both longitudinal and lateral movement to allow for quick lateral movements in activities such as basketball and tennis.

The operation of the SCS 2 will now be explained in view of the shoe of FIG. 1. When a pair of spring cushioned shoes is placed in use by a user, for example a runner, the region of the shoe containing wave spring 15 strikes the running surface first. The strike force applied by the calcaneus portion of the foot compresses the wave spring to a prescribed height before the foot is brought to rest and the body mass is dynamically transferred to the metatarsal region of the foot in contact with the surface where the wave spring 19 becomes compressed. When the body mass is transferred to the metatarsal region of the foot, wave spring 15 which was in the initial foot strike undergoes a compress—recoil cycle. As the user lifts the metatarsal region of the foot, energy is transferred to this region as wave spring 19 recoils. Thus, wave springs 15 and 19 both provide cushioning and energy return to the user of the SCS 2.

Figure 11:
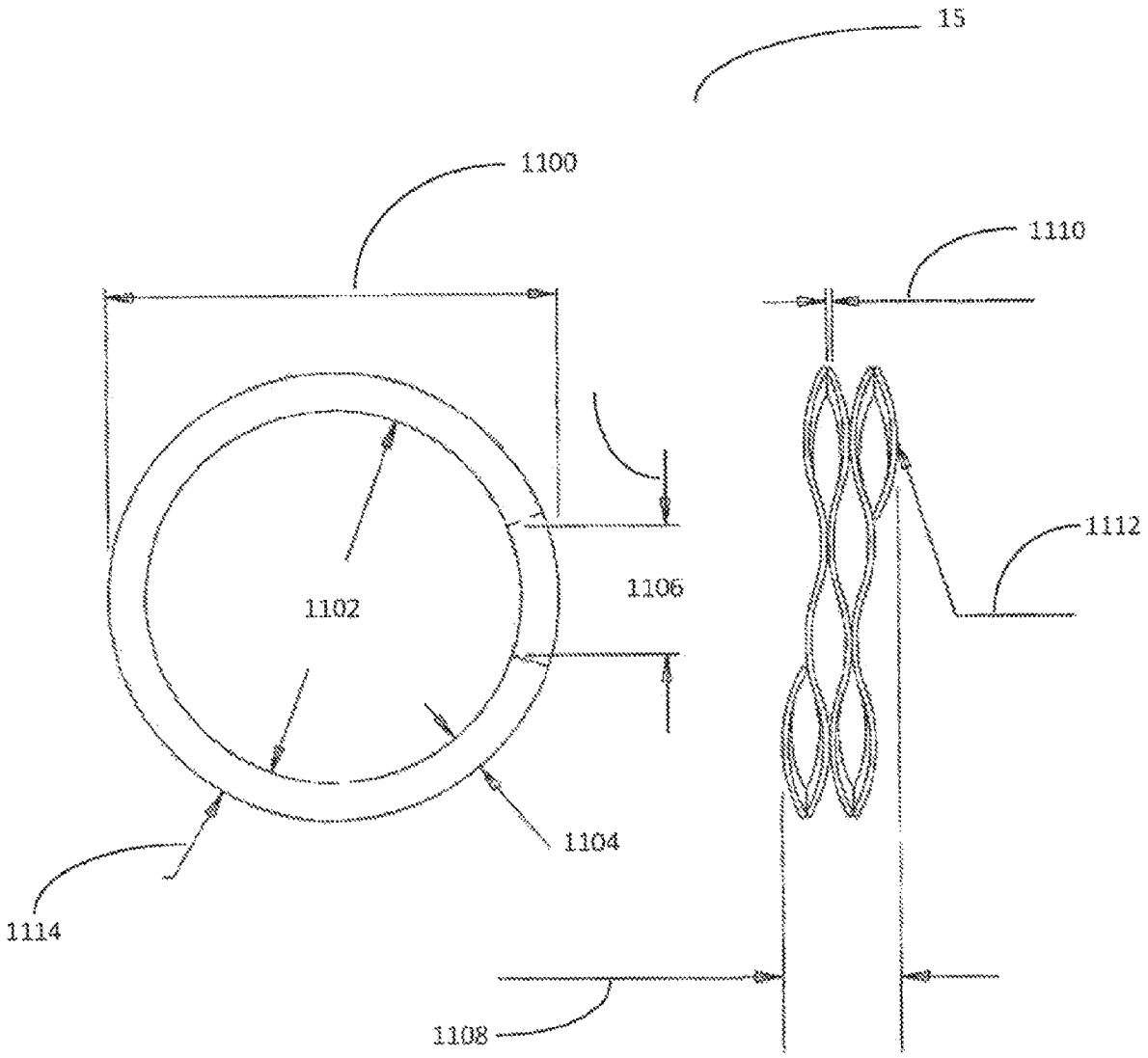
FIG. 11 illustrates a top and side view of a wave spring in accordance with an aspect of the present disclosure.

FIG. 11 illustrates a top and side view of a wave spring in accordance with an aspect of the present disclosure.

FIG. 11 illustrates wave spring 15 (or 19) having an outer diameter 1100, an inner diameter 1102, a radial wall thickness 1104, a free gap 1106, a height 1108, a wire thickness 1110, a number of turns 1112, and a number of waves 1114.

In an aspect of the present disclosure, characteristics 1100-1114 of wave spring 15 may be varied to provide different levels of compression/expansion, as well as to provide different sizes for wave spring 15.

Depending on the placement of wave spring 15 (or 19), the outer diameter 1100, inner diameter 1102, radial wall thickness 1104, and wire thickness 1110 may be changed for tuning of the shoe 2 to an individual person or group of persons. For example, and not by way of limitation, the outer diameter 1100 may vary from 1 inch to 3 inches, such that wave spring 15 may be located at various different locations in shoe 2. Further, inner diameter 1102 may vary from 0.75 inches to 2.5 inches, radial wall thickness 1104 may vary from 0.1 inches to 0.3 inches, and wire thickness may vary from 0.01 inches to 0.08 inches. The ranges given herein are for explanation only; variations of these characteristics of wave spring 15 (or 19) may fall outside of these ranges without departing from the scope of the present disclosure.

The height 1108, free gap 1106, number of turns 1112, and number of waves 1114 may also be varied to allow wave spring 15 (or 19) to fit within desired design parameters of shoe 2. For example, the number of waves 1114 may vary from 1 to 10, the number of turns 1112 may vary from 1 to 10, the free height 1108 may vary from 0.1 inch to 1 inch, and the free gap may be from 0.1 inch to 0.5 inches without departing from the scope of the present disclosure. The ranges given herein are for explanation only; variations of these characteristics of wave spring 15 (or 19) may fall outside of these ranges without departing from the scope of the present disclosure.

By changing the characteristics 1100-1114, the spring constant (also referred to as a "spring rate" herein) may be varied to allow shoe 2, via wave springs 15 and/or 19, to absorb more impact shock for various conditions. As an example, walking generates less impact shock than running. As such, a wave spring 15 and/or 19 for a walking shoe may need a lower spring rate than a running shoe. For example, and not by way of limitation, by controlling the characteristics 1100-1114, spring rates of 200 pounds per inch to 700 pounds per inch are possible for wave spring 15 and/or 19 without departing from the scope of the present disclosure. The ranges given herein are for explanation only; variations of these characteristics of wave spring 15 (or 19) may fall outside of these ranges without departing from the scope of the present disclosure.

When the spring rates described in FIG. 11 are combined with at least one compression modulus for encapsulant 16, the overall effective spring rate of wave spring 15 and/or 19 can be changed or tuned by combining a specific wave spring 15 and/or 19 having certain characteristics with a certain encapsulant 16 having certain characteristics, e.g., a compression modulus of between 1 to 50 C, or having an equivalent spring rate, etc., to achieve a desired overall spring rate. It is also envisioned within the scope of the present disclosure that the encapsulant 16 may provide little or no change in the spring rate for a given wave spring 15 and/or 19.

Figure 12:
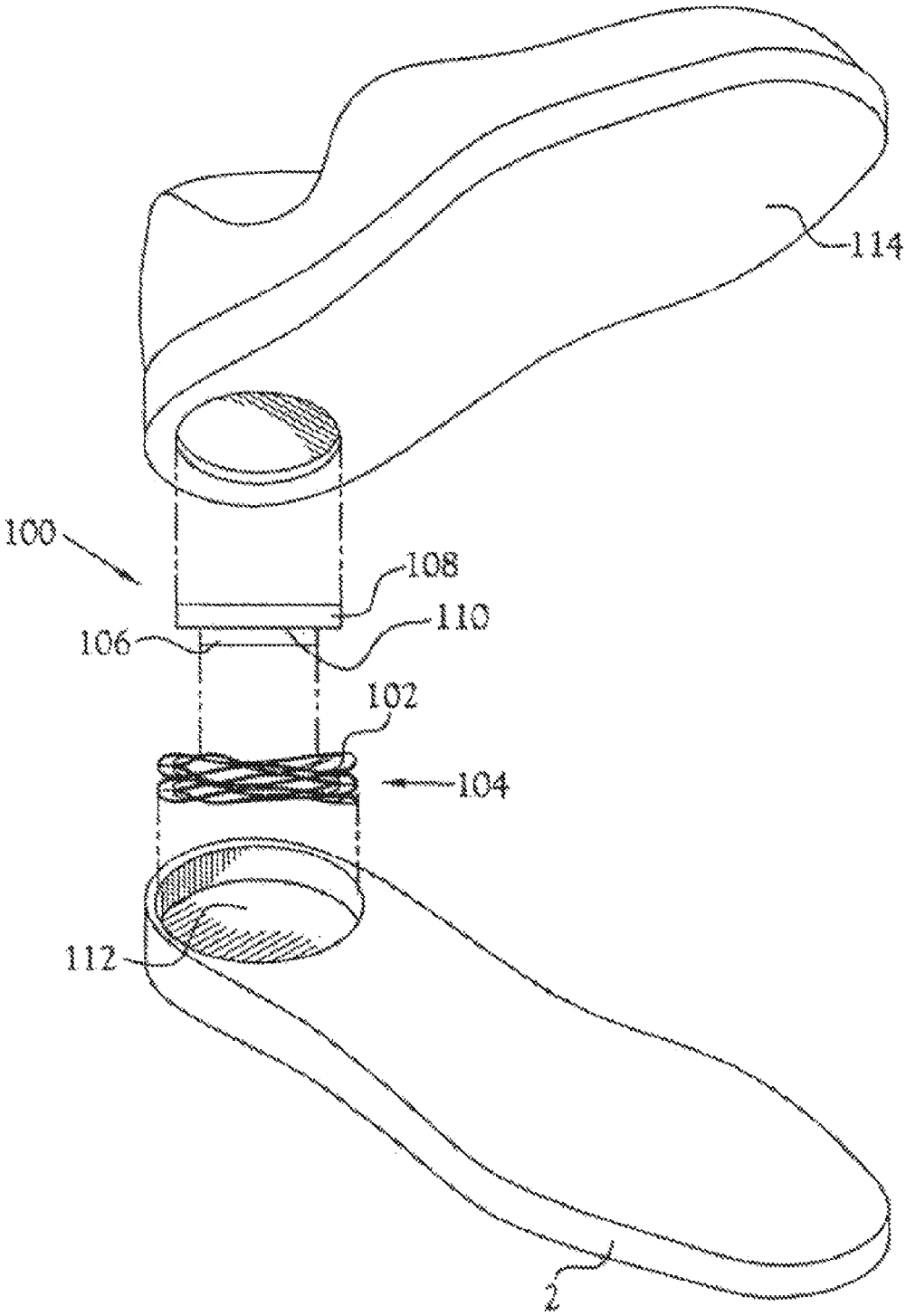
FIG. 12 illustrates an exploded perspective view of an alternative embodiment of a shoe in accordance with the present disclosure in an aspect of the present disclosure.

FIG. 12 illustrates an exploded perspective view of an alternative embodiment of a shoe in accordance with the present disclosure in an aspect of the present disclosure.

Another embodiment of the present disclosure, depicted in FIG. 12, provides a plate 100 located on the top surface 102 of the wave spring 104, which is located within the vacuity 112 in the heel region of the sole. The plate 100 includes a tubular lower section 106 and a peripheral flange 108 located adjacent to the top edge 110 of the tubular lower section 106. The diameter of the tubular lower section 106 is smaller than the diameter of the vacuity 112. In this embodiment, the vacuity 112 operates similar to a cylinder bore and the plate 100 above the wave spring functions like a piston by cycling between the top of the vacuity 112 and a depth below the top of the vacuity 112. This embodiment increases the natural function of the wave spring 104 because the containment of the wave spring is not as limited as when the perimeter of the top plate is bonded to the top surface of the midsole 114. This embodiment also increases the responsiveness of a rolling foot strike during the opposing expansion/compression pressures previously disclosed because the top plate is free to move with the top surface 102 of the wave spring.

Figure 13:
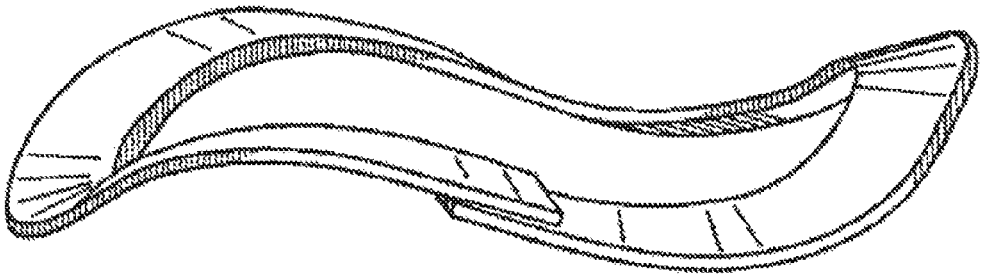
FIG. 13 illustrates a perspective view of an overlapping-type wave spring in an aspect of the present disclosure.
Figure 14:
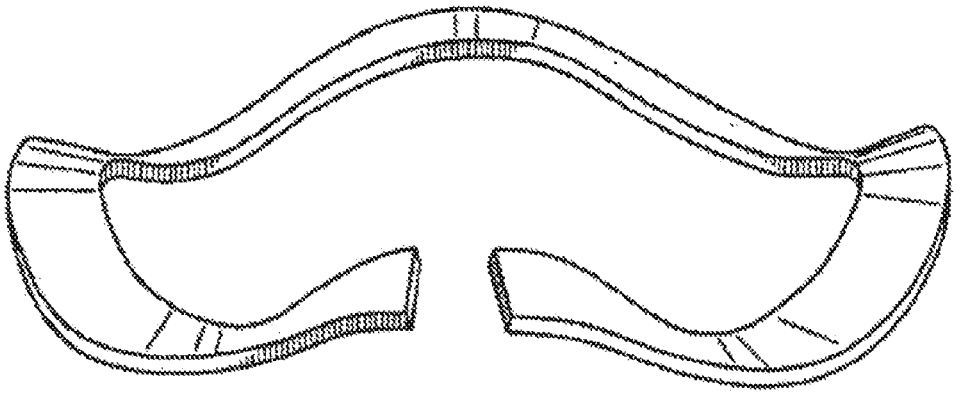
FIG. 14 illustrates a perspective view of a gap-type wave spring in an aspect of the present disclosure.

FIG. 13 illustrates a perspective view of an overlapping-type wave spring in an aspect of the present disclosure, and FIG. 14 illustrates a perspective view of a gap-type wave spring in an aspect of the present disclosure.

The wave spring 104 may comprise either a multi-turn wave spring or a single-turn wave spring. A single turn wave spring uses the crests of the single turn to act as natural levers to rock the single turn wave spring against either upper and/or lower plate(s) to increase energy return responsive to a rolling foot strike. FIGS. 12 and 13 illustrate variations of the single-turn wave spring. Specifically, FIG. 13 shows a gap-type wave spring and FIG. 14 shows an overlapping-type wave spring.

As with all wave springs, the single-turn wave spring is made up of a continuum of rising and falling crests. However, the ends of single-turn wave spring are free to move circumferentially and independently of each other. In the present disclosure, the single-turn Wave spring has two modes of reaction to a foot strike. When the foot strike applies force across more than one of the rising crests in a substantially even manner, the single-turn wave spring responds by radial expansion and recovers by radial contraction. However, in the case of a rolling foot strike where pressure is applied primarily to a single rising crest, the falling crests on either side cooperate as a fulcrum resulting the single-turn wave spring pivoting along an axis defined between the two falling crests. The resulting rocking motion provides the desired energy return.

During foot strike (whether from jumping or running), peak forces of several times the body weight are imparted to the wave springs. Assuming that an average user of the shoes weighs 165 lbs, average peak forces greater than 300 lbf/in. may be imparted to the wave springs. Hence, the previous mentioned spring rates could be used for a 165-lb person.

Wave springs are ideal for use in this limited space application. Conventional spring methods are inferior in shoe cushioning applications because of the limited combination of force, deflection, and space requirements.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a view of the device as shown in the present disclosure. Of course, if the device is inverted, above becomes below, and vice versa. Additionally, if oriented sideways, above and below may refer to sides of a device. Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

Those of skill would further appreciate that the various illustrative logical blocks, modules, and algorithm steps described in connection with the disclosure herein may be implemented as various different types of materials and/or various different combinations of materials. To clearly illustrate this interchangeability, various illustrative components, blocks, modules, and steps have been described above generally in terms of their functionality. The various materials and/or combinations of materials employed to implement the present disclosure depends upon the particular application and design constraints imposed on the overall system. Skilled artisans may implement the described functionality in varying ways for each particular application, but such implementation decisions should not be interpreted as causing a departure from the scope of the present disclosure.

The description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

Although several embodiments have been described in detail for purposes of illustration, various modifications may be made without departing from the scope and spirit of the present disclosure. Accordingly, the disclosure is not to be limited by the examples presented herein, but is envisioned as encompassing the scope described in the appended claims and the full range of equivalents of the appended claims.

What is claimed is:

1. A shoe comprising:

an upper portion;

a sole assembly, coupled to the upper portion;

at least one wave spring with a spring constant having a crest and a trough and an upper spring surface and a lower spring surface wherein a first end and a second end of the single turn wave spring is free to move circumferentially and independently;

a u-shaped receiving clip comprising protrusions, wherein the protrusions slidably accept a shim end of the at least one wave spring;

a spring compression limiter, wherein one of the terminal ends of the spring compression limiter is attached to an inner surface of the u-shaped receiving clip at a diametrical center of the protrusions;

a vacuity in the sole assembly; and an encapsulant having a compression modulus for coupling each crest and trough of the wave spring, wherein energy is transmitted from the wave spring to the coupled encapsulant during use, and further wherein the shoe has a target effective spring constant based on the spring constant of the selected wave spring and the compression modulus of the selected encapsulant.

2. The shoe of claim 1, wherein the spring constant is selected based at least in part on a position of the vacuity in the sole assembly.

3. The shoe of claim 2, in which the encapsulant comprises at least one of polypropylene, polyurethane, polystyrene, ethylene vinyl acetate (EVA), rubber, plastic, foam, other polymers, and/or other compressible materials.

4. The shoe of claim 1, in which the vacuity in the sole assembly is in a heel section of the sole assembly.

5. The shoe of claim 1, in which the vacuity in the sole assembly is in a middle section of the sole assembly.

6. The shoe of claim 1, in which the vacuity in the sole assembly is in a front section of the sole assembly.

7. The shoe of claim 1, in which the sole assembly comprises a plurality of vacuities, each vacuity in the plurality of vacuities designed to accept at least one of the at least one wave springs.

8. The shoe of claim 7, in which the at least one wave spring in each vacuity in the plurality of vacuities comprises a different effective spring constant.

9. The shoe of claim 1, in which the spring constant of the at least one wave spring is selected based at least in part on an expected force at the vacuity in which the at least one wave spring is mounted.

10. A shoe comprising:

an upper portion;

a sole assembly, coupled to the upper portion;

at least one single-turn wave spring with a spring constant having a crest and a trough and an upper spring surface and a lower spring surface wherein a first end and a second end of the single turn wave spring is free to move circumferentially and independently;

a u-shaped receiving clip comprising protrusions, wherein the u-shaped receiving clip has a first interior surface positioned adjacent the upper spring surface of the at least one wave spring and a second interior surface positioned adjacent the lower spring surface of the at least one wave spring and further wherein the protrusions slidably accept a shim end of the at least one wave spring;

a vacuity in the sole assembly; and an encapsulant having a compression modulus for coupling each crest and trough of the single-turn wave spring, wherein energy is transmitted from the wave spring to the encapsulant during use, and further wherein the shoe has a target effective spring rate based on the spring rate of the selected single-turn wave spring and the compression modulus of the selected encapsulant.

11. The shoe of claim 10, wherein the the spring constant is selected based at least in part on a position of the vacuity in the sole assembly.

12. The shoe of claim 11, in which the encapsulant comprises at least one of polypropylene, polyurethane, polystyrene, ethylene vinyl acetate (EVA), rubber, plastic, foam, other polymers, and/or other compressible materials.

13. The shoe of claim 10, in which the vacuity in the sole assembly is in a heel section of the sole assembly.

14. The shoe of claim 10, in which the vacuity in the sole assembly is in a middle section of the sole assembly.

15. The shoe of claim 10, in which the vacuity in the sole assembly is in a front section of the sole assembly.

16. The shoe of claim 10, in which the sole assembly comprises a plurality of vacuities, each vacuity in the plurality of vacuities designed to accept at least one of the at least one wave springs.

17. The shoe of claim 16, in which the at least one wave spring in each vacuity in the plurality of vacuities comprises a different effective spring constant.

18. The shoe of claim 10, in which a spring constant of the at least one wave spring is selected based at least in part on an expected force at the vacuity in which the at least one wave spring is mounted.

* * * * *